US009372453B2

(12) United States Patent
Hidaka et al.

(10) Patent No.: US 9,372,453 B2
(45) Date of Patent: Jun. 21, 2016

(54) FIXING DEVICE AND IMAGE FORMING APPARATUS

(71) Applicant: FUJI XEROX CO., LTD., Tokyo (JP)

(72) Inventors: Keisuke Hidaka, Kanagawa (JP); Norio Ogawahara, Kanagawa (JP); Shogo Kamiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/631,957

(22) Filed: Feb. 26, 2015

(65) Prior Publication Data

US 2016/0077477 A1 Mar. 17, 2016

(30) Foreign Application Priority Data

Sep. 17, 2014 (JP) ..... 2014-188692

(51) Int. Cl.
*G03G 15/20* (2006.01)

(52) U.S. Cl.
CPC ..... *G03G 15/2053* (2013.01); *G03G 15/2032* (2013.01); *G03G 15/2064* (2013.01); *G03G 2215/2016* (2013.01); *G03G 2215/2032* (2013.01)

(58) Field of Classification Search
CPC ..... G03G 15/20
USPC ..... 399/329
See application file for complete search history.

(56) References Cited

U.S. PATENT DOCUMENTS 5,436,710 A * 7/1995 Uchiyama ..... G03G 15/2007 219/216
8,467,712 B2 6/2013 Kodera et al.
8,594,551 B2 * 11/2013 Nonaka ..... G03G 15/2053 399/122
8,750,778 B2 * 6/2014 Maeda ..... G03G 15/201 399/336
8,948,674 B2 * 2/2015 Kodera ..... G03G 15/201 399/329
2011/0236821 A1 * 9/2011 Kageyama ..... G03G 15/201 430/124.1
2011/0262196 A1 * 10/2011 Maeda ..... G03G 15/2007 399/336
2012/0045238 A1 * 2/2012 Maeda ..... G03G 15/201 399/67
2013/0071162 A1 * 3/2013 Maeda ..... G03G 15/2007 399/336
2013/0243502 A1 * 9/2013 Egusa ..... G03G 15/2007 399/336
2015/0093170 A1 * 4/2015 Kodera ..... G03G 15/2007 399/336

FOREIGN PATENT DOCUMENTS

JP S536044 * 1/1978 ..... G03G 15/20
JP H06301304 * 10/1994 ..... G03G 15/20
JP 2011128223 * 6/2011 ..... G03G 15/20
JP 2012-088372 A 5/2012
JP 2013-057855 A 3/2013

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

A fixing device includes a light source that radiates a laser beam, a converging member that converges the laser beam, and a roller that is positioned so as to be in contact with the converging member and that transports a recording medium, which enters between the roller and the converging member. The converging member includes a lens that converges the laser beam, which is incident on a first surface of the lens, and emits the laser beam from a second surface of the lens and a holding member made of a material that does not transmit the laser beam, the holding member holding the lens. In the cross-sectional view perpendicular to a rotation axis of the roller, a contact surface in which the roller and the converging member are in contact with each other includes at least a portion of a surface of the holding member and the second surface.

17 Claims, 8 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2014-188692 filed Sep. 17, 2014.

BACKGROUND (i) Technical Field

The present invention relates to a fixing device and an image forming apparatus.

(ii) Related Art

A technique for fixing toner onto a recording medium by radiating a laser beam onto the toner has been employed in image forming apparatuses.

SUMMARY

According to an aspect of the invention, there is provided a fixing device including a light source that radiates a laser beam, a converging member that converges the laser beam, and a roller that is disposed at a position where the roller is in contact with the converging member and that transports a recording medium, which enters between the roller and the converging member. The converging member includes a lens having a first surface on which the laser beam is incident and a second surface from which the laser beam is to be emitted, the lens being configured to converge the laser beam, which has been incident on the first surface, and emit the laser beam from the second surface, and a holding member made of a material that does not transmit the laser beam, the holding member holding the lens. In a cross-sectional view perpendicular to a rotation axis of the roller, a contact surface in which the roller and the converging member are in contact with each other includes at least a portion of a surface of the holding member and the second surface.

BRIEF DESCRIPTION OF THE DRAWINGS

Exemplary embodiments of the present invention will be described in detail based on the following figures, wherein.

DETAILED DESCRIPTION

1. Exemplary Embodiment

1-1. Overall Configuration

Figure 1:
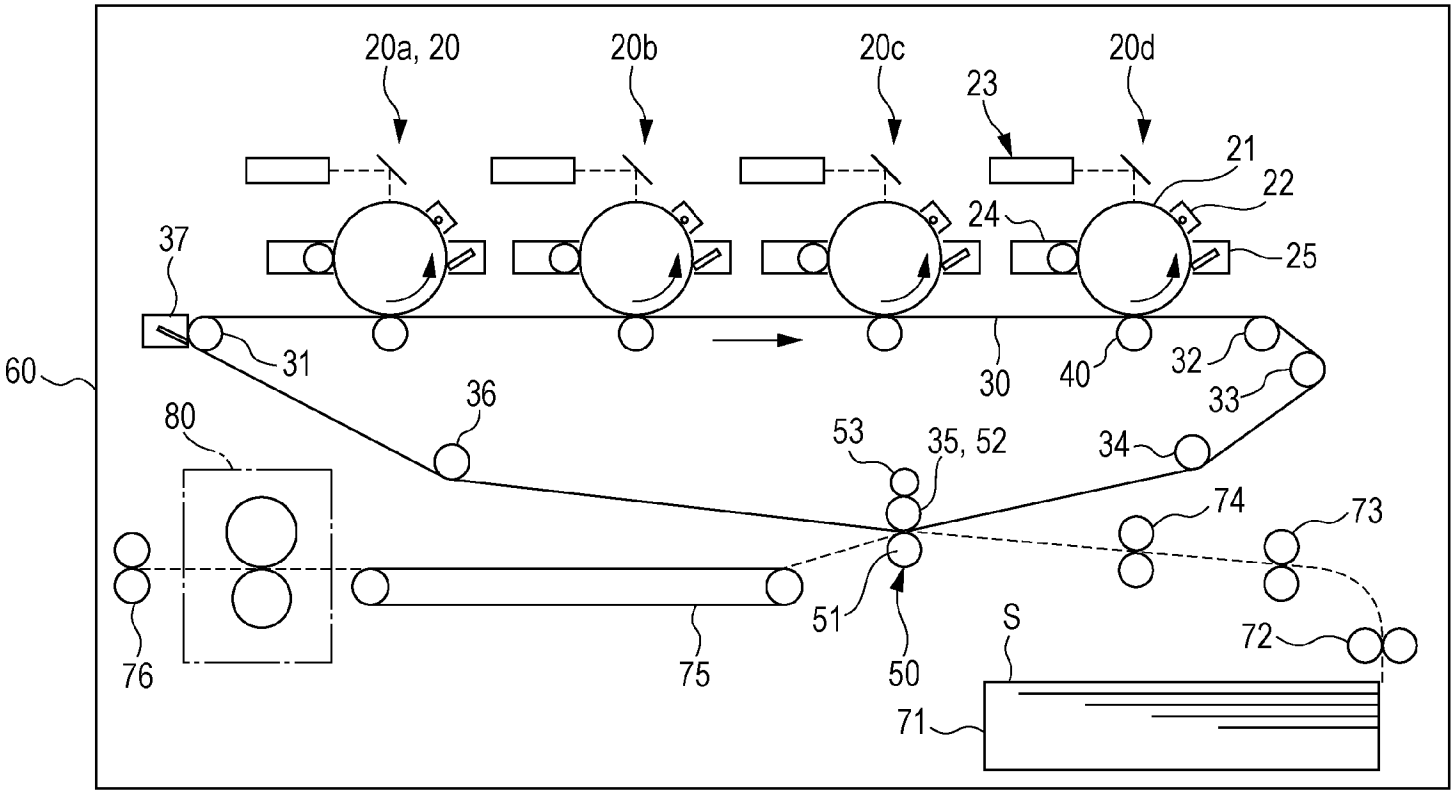
FIG. 1 is a diagram illustrating the overall configuration of an image forming apparatus.

FIG. 1 is a diagram illustrating the overall configuration of an image forming apparatus. The image forming apparatus includes image forming units 20, an intermediate transfer body 30, a collective-transfer device 50, and a fixing device 80, and these units and devices are disposed in an apparatus housing 60. The image forming units 20 (specifically, 20*a* to 20*d*) form images (toner images) having different color components (yellow (Y), magenta (M), cyan (C), and black (K) in the present exemplary embodiment) on one of recording media S by using image-forming materials. The intermediate transfer body 30 is a belt-shaped member and temporarily holds and transfers the images, which have the different color components and which have been formed by the image forming units 20, before transferring the images onto the recording medium S. The collective-transfer device (second transfer device) 50 collectively transfers the images, which have the different color components and which have been held on the intermediate transfer body 30, onto the recording medium S. The fixing device 80 fixes the images, which have been transferred but not yet fixed to the recording medium S by the collective-transfer device 50, onto the recording medium S. At least one of the image forming units 20, the intermediate transfer body 30, and the collective-transfer device 50 is an example of an image forming unit that forms a toner image on one of the recording media S.

An electrophotographic system is employed in the basic configuration of each of the image forming units 20. Each of the image forming units 20 includes a photoconductor 21, and a charging device 22, a latent-image-writing device 23, a developing device 24, and a cleaning device 25 are disposed in this order around the periphery of the photoconductor 21. Each of the photoconductors 21 is a drum-shaped member that has a surface over which a photosensitive layer is formed and that is rotatable in a predetermined direction. Each of the charging devices 22 is, for example, a corotron and charges the corresponding photoconductor 21 beforehand. Each of the latent-image-writing devices 23 is, for example, a laser-scanning device and writes an electrostatic latent image by light on the corresponding photoconductor 21, which has been charged by the corresponding charging device 22. Each of the developing devices 24 develops the electrostatic latent image, which has been written by the corresponding latent-image-writing device 23, with a corresponding one of the color components. Each of the cleaning devices 25 removes residual toner and the like on the corresponding photoconductor 21.

The intermediate transfer body 30 is a belt member that is stretched by plural stretching rollers 31 to 36. The intermediate transfer body 30 is configured to circularly rotate in a predetermined direction as a result of, for example, the stretching roller 31 serving as a driving roller and the stretching rollers 32 to 36 serving as driven rollers. In the present exemplary embodiment, the stretching roller 33 functions as a tension-applying roller that exerts a predetermined tension on the stretching roller 30, and the stretching roller 35 is also used as a counter roller 52, which is one of the components of the collective-transfer device 50.

First transfer devices 40 are disposed on portions of the rear surface of the intermediate transfer body 30, the portions corresponding to the image forming units 20 (20*a* to 20*d*). In the present exemplary embodiment, each of the first transfer devices 40 includes, for example, a transfer roller, to which a first transfer voltage is to be applied, and is configured to transfer an image formed on the corresponding photoconductor 21 onto the intermediate transfer body 30 in a first transfer process by generating a first transfer electric field between the transfer roller and the photoconductor 21. An intermediate-transfer-body-cleaning device 37 removes residual toner and the like on the intermediate transfer body 30.

The collectively-transfer device (second transfer device) 50 includes the stretching roller 35 of the intermediate transfer body 30 as the counter roller 52. In addition, the collectively-transfer device 50 includes a transfer roller 51 that is disposed at a position on the front surface of the intermediate transfer body 30, the position facing the counter roller 52, and a power supplying roller 53 that is disposed on the surface of the counter roller 52. In the present exemplary embodiment, the collectively-transfer device 50 is configured to generate a collective-transfer-electric field (second transfer electric field) between the transfer roller 51 and the intermediate transfer body 30 by applying a collective-transfer voltage (second transfer voltage) to the power supplying roller 53 and causing the transfer roller 51 to be grounded and is configured to collectively transfer images, which have the different color components and which are located on the intermediate transfer body 30, onto one of the recording media S. The recording media S are accommodated in an accommodating device 71. The recording media S are sent out one by one from the accommodating device 71 and then transported to a pair of positioning rollers 74 by passing through pairs of transport rollers 72 and 73. After being positioned by the pair of positioning rollers 74, the recording media S are transported to a collective transfer region in the collective-transfer device 50. After passing through the collective transfer region, the recording media S are transported to the fixing device 80 by passing through a transport belt 75 and are ejected to an ejection tray (not illustrated) via a pair of ejection rollers 76.

1-2. Configuration of Fixing Device

Figure 2:
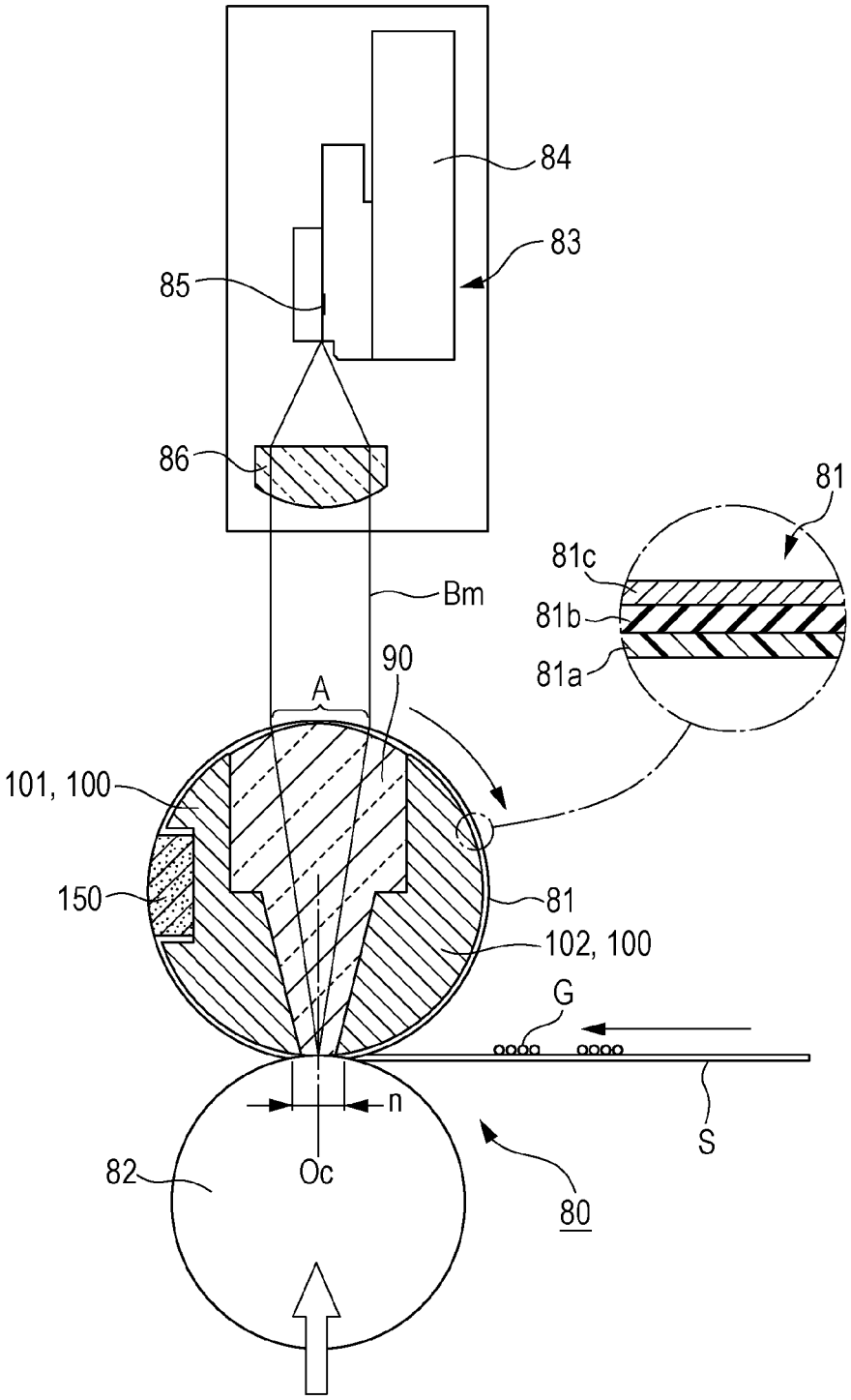
FIG. 2 is a diagram illustrating the overall configuration of a fixing device and the cross-sectional configuration example of a transparent tube.

FIG. 2 is a diagram illustrating the overall configuration of the fixing device 80 and the cross-sectional configuration example of a transparent tube 81. The fixing device 80 includes the transparent tube 81 (an example of a cylinder member), a counter roller 82 (an example of a roller), a laser-beam-radiation device 83 (an example of a light source), a lens pad 90, and a holding frame 100 (an example of a holding member). The transparent tube 81 is a cylinder member made of a material that transmits laser beams Bm. The holding frame 100 and the lens pad 90 are accommodated in the transparent tube 81. The holding frame 100 and the lens pad 90 are not fixed to the transparent tube 81, and the transparent tube 81 rotates relative to the holding frame 100 and the lens pad 90. The counter roller 82 is positioned so as to be in contact with the lens pad 90 and transports one of the recording media S that enters between the counter roller 82 and the lens pad 90. In the present exemplary embodiment, the term "between the counter roller 82 and the lens pad 90" refers to a gap between the counter roller 82 and the lens pad 90. In the present exemplary embodiment, the counter roller 82 is disposed in such a manner as to face the transparent tube 81 and defines a contact region n between the counter roller 82 and the transparent tube 81. The transparent tube 81 rotates along with rotation of the counter roller 82 and transports one of the recording media S.

The laser-beam-radiation device 83 is disposed outside the transparent tube 81 and radiates the laser beams Bm toward a predetermined light-incident position A on the transparent tube 81. The lens pad 90 is disposed in the transparent tube 81 and presses the transparent tube 81 against the counter roller 82 in the contact region n of the transparent tube 81. In addition, the lens pad 90 is a pressing and converging member that causes, in the contact region n, the laser beams Bm, which have been radiated to the light-incident position A on the transparent tube 81, to converge on an image G on one of the recording media S in the direction in which the recording medium S is to be transported.

1-2-1. Transparent Tube

The transparent tube 81 rotates along with rotation of the counter roller 82 and transports one of the recording media S. In the present exemplary embodiment, the term "transparent" in "transparent tube 81" refers to having a transmittance higher than a predetermined threshold in the wavelength range of the laser beams Bm. In the present exemplary embodiment, the transmittance of the transparent tube 81 is not particularly limited as long as the transparent tube 81 transmits the laser beams Bm, and from the standpoint of light use efficiency and preventing the lens pad 90 from being heated, it is better to have a high transmittance, and the transmittance of the transparent tube 81 may be, for example, 90% or higher, and desirably 95% or higher.

As illustrated in FIG. 2, the transparent tube 81 has a three-layer structure formed of a base material layer 81*a*, an elastic layer 81*b*, and a release layer 81*c*. The base material layer 81*a* is provided in order to maintain a necessary strength. The elastic layer 81*b* is stacked on the base material layer 81*a*. The release layer 81*c* is stacked on the elastic layer 81*b* and formed of a member that allows toners, which are image-forming materials, to easily separate therefrom. Note that, in the present exemplary embodiment, it is obvious that the transparent tube 81 is not limited to having the three-layer structure and may have a layer that serves as the three-layer structure.

The base material layer 81*a* is made of a material selected from the group including polyvinylidene difluoride (PVDF), a polyimide (PI), a polyethylene (PE), polyurethane (PU), a silicone such as polydimethylsiloxane (PDMS), polyether ether ketone (PEEK), polyethersulfone (PES), fluorinated ethylene propylene (FEP), ethylene tetrafluoroethylene copolymer (ETFE), chlorotrifluoroethylene (CTFE), polyvinylidene difluoride (PVDF), polyvinyl fluoride (PVF), polytetrafluoroethylene (PTFE), and mixtures of the above materials. The elastic layer 81*b* is made of a liquid silicone rubber (LSR), high temperature vulcanization (HTV) silicone rubber, a room temperature vulcanization (RTV) silicone rubber, or the like. The elastic layer 81*b* may transmit the laser beams Bm and have elasticity for accommodating surface irregularities of the recording medium S and steps in the image G formed of the toners. The release layer 81*c* is made of a fluorine resin, for example, polytetrafluoroethylene (PTFE), polytetrafluoroethylene perfluoroalkoxyethylene copolymer (PFA), polytetrafluoroethylene hexafluoropropylene copolymer (FEP), or the like. The release layer 81*c* may transmit the laser beams Bm and facilitate separation of the image G formed of the toners on the recording medium S and the transparent tube 81 from each other. Note that the release layer 81*c* also has a function of providing, together with the elastic layer 81*b*, gloss to an image that has been fixed to one of the recording media S.

1-2-2. Counter Roller

The counter roller 82 is formed of a copper sheet, which is coated with, for example, aluminum, stainless steel, or nickel, and the like. The counter roller 82 is disposed in such a manner that a predetermined pressing force is exerted between the counter roller 82 and the transparent tube 81.

1-2-3. Laser-Beam-Radiation Device

The laser-beam-radiation device 83 includes a laser array 84 and a collimator lens 86. The laser array 84 includes plural laser sources 85 that are arranged in an array in the vertical direction as viewed in FIG. 2. The collimator lens 86 is an optical element that causes the laser beams Bm emitted from the laser sources 85 of the laser array 84 to become collimated light beams. The collimator lens 86 is incorporated into a housing (not illustrated) of the laser-beam-radiation device 83. The laser-beam-radiation device 83 is configured in such a manner that a position onto which the laser beams Bm from the laser sources 85 are to be radiated and the intensity of the laser beams Bm are selectable. Each of the laser sources 85 includes, for example, a laser element, such as a solid-state laser, a liquid laser, a gas laser, or a semiconductor laser, and radiates one of the laser beams Bm.

1-2-4. Lens Pad

The lens pad 90 converges the laser beams Bm, which have been radiated to the light-incident position A on the transparent tube 81, on the image G (toner image) on one of the recording media S in the contact region n. The material of the lens pad 90 may be selected from materials each having heat resistance among materials that are usually used for manufacturing lenses, and examples of such materials include various glass materials for optical use and a transparent plastic resin for optical use. Examples of the transparent plastic resin for optical use include materials including polydiethylene glycol bisallyl carbonate (PADC), polymethylmethacrylate (PMMA), a polystyrene (PSt), a polymer (MS resin) containing a methyl methacrylate unit and a styrene unit, a polycarbonate resin, a cycloolefin resin, a fluorene resin, and the like.

The lens pad 90 may be designed in such a manner as to have an optimum focal depth given to the distance from a portion on which the laser beams Bm are incident to a portion from which the laser beams Bm are emitted. It is obvious that the lens pad 90 has its converging effect, and in addition, the lens pad 90 is in contact with the transparent tube 81 at positions corresponding to the light-incident position A and the contact region n and has a function of pressing the image G on one of the recording media S in the contact region n. In this case, given the relationship with the heating energy of the laser beams Bm, the pressing force to be exerted by the lens pad 90 may be set within a range in which a predetermined fixability may be obtained.

Figure 3:
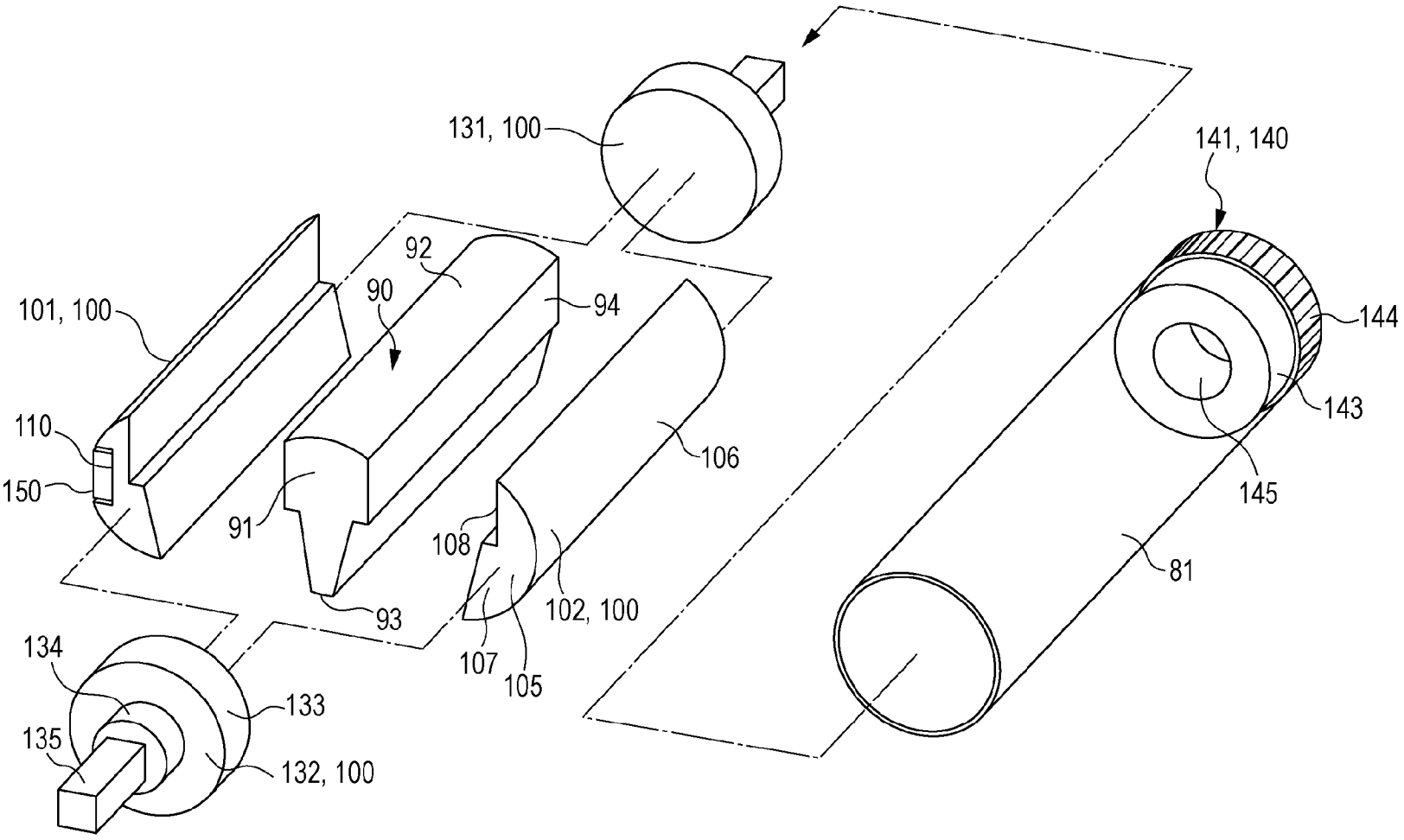
FIG. 3 is an exploded view illustrating components for assembling a principal portion of the fixing device.
Figure 4:
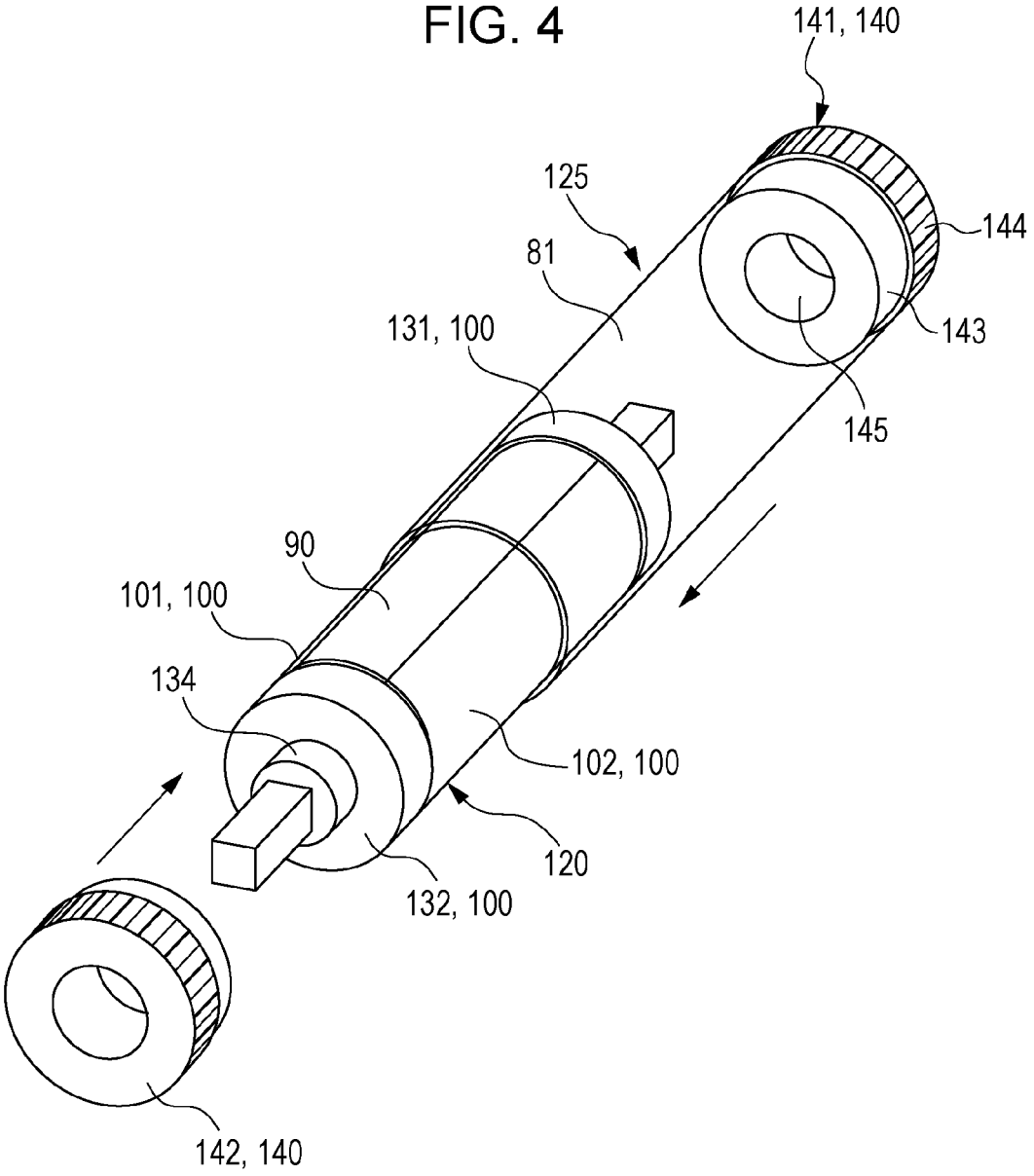
FIG. 4 is a diagram illustrating a state where the components for assembling the fixing device have been assembled.

FIG. 3 is an exploded diagram illustrating components for assembling a principal portion of the fixing device 80, and FIG. 4 is a diagram illustrating a state where the components for assembling the fixing device 80 have been assembled. As illustrated in FIGS. 2 and 3, the lens pad 90 includes a lens body 91 (an example of a lens) that converges the laser beams Bm that are radiated from the laser array 84 toward a transmission direction. The lens body 91 is formed of a lens member having an elongated shape and extending in the longitudinal direction of the laser array 84. The lens body 91 has a light-incident surface 92 (first surface) and a light-emitting surface 93 (second surface). The light-incident surface 92 is a portion corresponding to the light-incident position A on the transparent tube 81 and is curved in a direction along the direction of rotation of the transparent tube 81. The light-emitting surface 93 is a portion corresponding to the contact region n, in which the transparent tube 81 and the counter roller 82 are in contact with each other, and is curved in the direction along the direction of rotation of the transparent tube 81. The light-incident surface 92 and the light-emitting surface 93 are positioned in such a manner as to be in contact with the inner surface of the transparent tube 81.

The holding frame 100 includes side holding frames 101 and 102 and end holding frames 131 and 132. The side holding frames 101 and 102 are a pair of holding frames that hold the lens pad 90 from both sides of the lens pad 90. The end holding frames 131 and 132 are members that fixes in place and holds end portions of the lens pad 90 and end portions of the pair of side holding frames 101 and 102 in the longitudinal direction with an adhesive (not illustrated). Each of the side holding frames 101 and 102 includes a frame member 105 that has an elongated shape and that is integrally formed of, for example, a metal containing aluminum or stainless steel, a synthetic resin, or the like. Each of the frame members 105 includes a guiding portion 106. The guiding portions 106 is a curved member having a radius of curvature substantially equivalent to the radius of curvature rc of the inner surface of the transparent tube 81.

Each of the end holding frames 131 and 132 includes an end lid body 133, a guide-step portion 134, and a support shaft 135. The end lid bodies 133 are members each of which has a circular cross section and each of which fixes in place ends of a substantially columnar subassembly that is formed by combining the lens pad 90 and the side holding frames 101 and 102. Each of the guide-step portions 134 is a member that is adjacent to the outer side of a corresponding one of the end lid bodies 133, that has a diameter smaller than that of the corresponding end lid body 133, and that includes a predetermined step portion in such a manner as to project outward. Each of the support shafts 135 is a member that has a non-circular cross section (rectangular cross section in the present exemplary embodiment), that is adjacent to the outer side of the corresponding guide-step portion 134, and that projects outward.

End caps 140 (specifically, 141 and 142) are disposed at the ends of the transparent tube 81 (see FIG. 4). Each of the end caps 140 includes an end ring 143 and a ring-shaped gear 144. The end rings 143 are members that are fitted into end portions of the inner surface of the transparent tube 81. The ring-shaped gears 144 are members that are formed integrally with the corresponding end rings 143 in such a manner as to be adjacent to the outer sides of the corresponding end rings 143 and that directly or indirectly apply a driving force, which causes the transparent tube 81 to rotate, to the transparent tube 81. In the present exemplary embodiment, end openings of the transparent tube 81 are not completely blocked by the end caps 140 (141 and 142), and through holes 145 are formed in the centers of the end rings 143 and the ring-shaped gears 144. Each of the guide-step portions 134 of the end holding frames 131 and 132 is inserted into the through hole 145 of a corresponding one of the end rings 143, and the end rings 143 is configured to rotate in such a manner as to be capable of sliding while being in contact with the guide-step portions 134 of the end holding frames 131 and 132. Each of the support shafts 135 of the end holding frames 131 and 132 are arranged in such a manner as to pass through the through hole 145 of a corresponding one of the ring-shaped gears 144 and project toward outside the ring-shaped gears 144.

Figure 5:
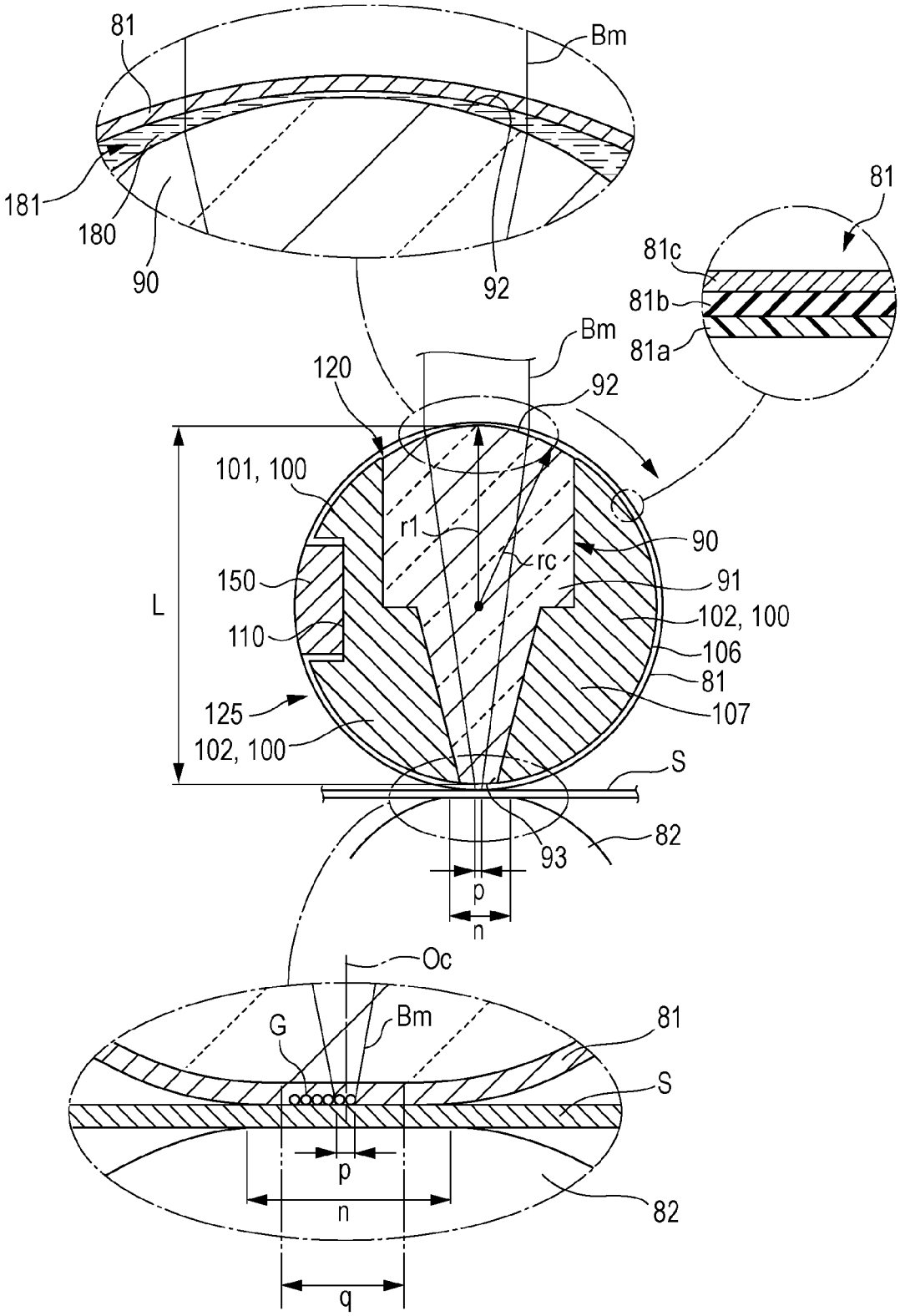
FIG. 5 is a diagram illustrating how laser beams are radiated at a light-incident position and a light-emitting position on the transparent tube of the fixing device and the cross-sectional configuration example of the transparent tube.

FIG. 5 is a diagram illustrating how the laser beams Bm are radiated at the light-incident position A and a light-emitting position on the transparent tube 81 of the fixing device 80 and the cross-sectional configuration example of the transparent tube 81. A radius of curvature r1 of the curved light-incident surface 92 of the lens pad 90 and a distance L between the light-incident surface 92 (first surface) and the light-emitting surface 93 (second surface) of the lens pad 90 are set beforehand in such a manner that the laser beams Bm, which are the collimated light beams that are incident on the light-incident position A on the transparent tube 81, are converged and focused on an area (a focal region p) in the vicinity of a substantially center Oc of the contact region n, in which the transparent tube 81 and the counter roller 82 are in contact with each other. In addition, the lens pad 90 includes plane portions 94 that are parallel to each other and that are formed on either side of the lens body 91 excluding the light-incident surface 92 and the light-emitting surface 93.

In the present exemplary embodiment, the lens pad 90 is fixed in place and held by the holding frame 100 (an example of a holding member) in the transparent tube 81. In the present exemplary embodiment, the holding frame 100 is made of a material (e.g., a metal such as stainless steel), which does not transmit the laser beams Bm, and holds the lens body 91. The lens pad 90 and the holding frame 100 are examples of a converging member according to the exemplary embodiment of the present invention.

In the present exemplary embodiment, as illustrated in FIG. 5, in the cross-sectional view perpendicular to a rotation axis of the counter roller 82, a position (focal region p) from which the laser beams Bm are to be emitted is located in the contact region n (contact surface), in which the counter roller 82, the lens pad 90, and the holding frame 100 are in contact with one another, and in addition, at least a portion of a surface of the holding frame 100 is located in the contact region n. Note that the term "at least a portion of a surface of the holding frame 100 is located in the contact region n" refers to a state where the projected area of at least a portion of the surface of the holding frame 100 on the contact region n is located in the contact region n when viewed from the center of the transparent tube 81. In other words, the area of a surface q (hereinafter referred to as "lens width q") in which the lens pad 90 faces the counter roller 82 with the transparent tube 81 interposed between the lens pad 90 and the counter roller 82 is smaller than that of the contact region n. In addition, in the present exemplary embodiment, as illustrated in FIG. 5, in the cross-sectional view perpendicular to the rotation axis of the counter roller 82, portions of the surface of the holding frame 100 that are located at either side of the lens width q are located in the contact region n. In particular, in the present exemplary embodiment, as illustrated in FIG. 5, the lens width q is positioned in the vicinity of the center of the contact region n.

1-2-5. Liquid Applicator

In the present exemplary embodiment, a liquid applicator 150 is disposed in the transparent tube 81 in order to apply transparent liquid onto the inner surface of the transparent tube 81. The transparent liquid functions as a lubricating material that reduces contact resistance between the transparent tube 81 and the lens pad 90. In the present exemplary embodiment, the liquid applicator 150 is a felt material that is to be impregnated with the transparent liquid such as, for example, silicone oil, or fluorine oil. In the mounting structure of the liquid applicator 150, for example, a mounting groove 110 having a substantially rectangular shape when viewed in cross section is formed in a portion of the guiding portion 106 of the side holding frame 101 along the longitudinal direction of the laser array 84, and a felt material, which serves as the liquid applicator 150, is caused to be constrained and held in the mounting groove 110, so that the liquid applicator 150 is brought into close contact with the inner surface of the transparent tube 81, and the transparent liquid with which the liquid applicator 150 has been impregnated is uniformly applied to the inner surface of the transparent tube 81.

1-2-6. Operation of Incorporating Lens-Pad Assembly and Liquid Applicator into Transparent Tube A process of incorporating the lens pad 90 into the transparent tube 81 will now be described. First, when causing the lens pad 90 to be held by the holding frame 100, as illustrated in FIG. 3, the lens pad 90 is held by the pair of side holding frames 101 and 102, and then the end portions of the lens pad 90 and the end portions of the side holding frames 101 and 102 are held by the end holding frames 131 and 132, so that a lens-pad assembly 120 (see FIG. 4) that is formed by assembling the lens pad 90 and the holding frame 100 is fabricated.

As illustrated in FIG. 4, after one of the end caps 140 (141 in the present exemplary embodiment) has been mounted in one of the end openings of the transparent tube 81, the lens-pad assembly 120 may be inserted from the other one of the end openings of the transparent tube 81, and the guide-step portion 134 of the end holding frame 131 of the lens-pad assembly 120 may be fitted into the end ring 143 of the one of the end caps 140 (141 in the present exemplary embodiment), which has been mounted on the transparent tube 81. In addition, the support shaft 135 of the end holding frame 131 may be caused to project from the through hole 145 of the ring-shaped gear 144 of the one of the end caps 140 (141 in the present exemplary embodiment). In a state where the lens pad 90 of the lens-pad assembly 120 is received in the transparent tube 81, the other one of the end caps 140 (142 in the present exemplary embodiment) may be mounted in the other one of the end openings of the transparent tube 81, and the guide-step portion 134 of the end holding frame 132 of the lens-pad assembly 120 may be fitted into the end ring 143 of the other one of the end caps 140 (142 in the present exemplary embodiment). In addition, the support shaft 135 of the end holding frame 132 may be caused to project from the through hole 145 of the ring-shaped gear 144 of the other one of the end caps 140 (142 in the present exemplary embodiment).

In addition, in the present exemplary embodiment, when the lens-pad assembly 120 is incorporated into the transparent tube 81, the liquid applicator 150, which is impregnated with the transparent liquid, is incorporated into the lens-pad assembly 120 beforehand, and in this state, the lens-pad assembly 120 and the liquid applicator 150 may be incorporated into the transparent tube 81. In this state, the operation of incorporating the lens-pad assembly 120 and the liquid applicator 150 into the transparent tube 81 is completed, and a transparent-tube assembly 125 into which the lens-pad assembly 120 and the liquid applicator 150 are incorporated is completed.

1-2-7. Driving System of Fixing Device

Figure 6:
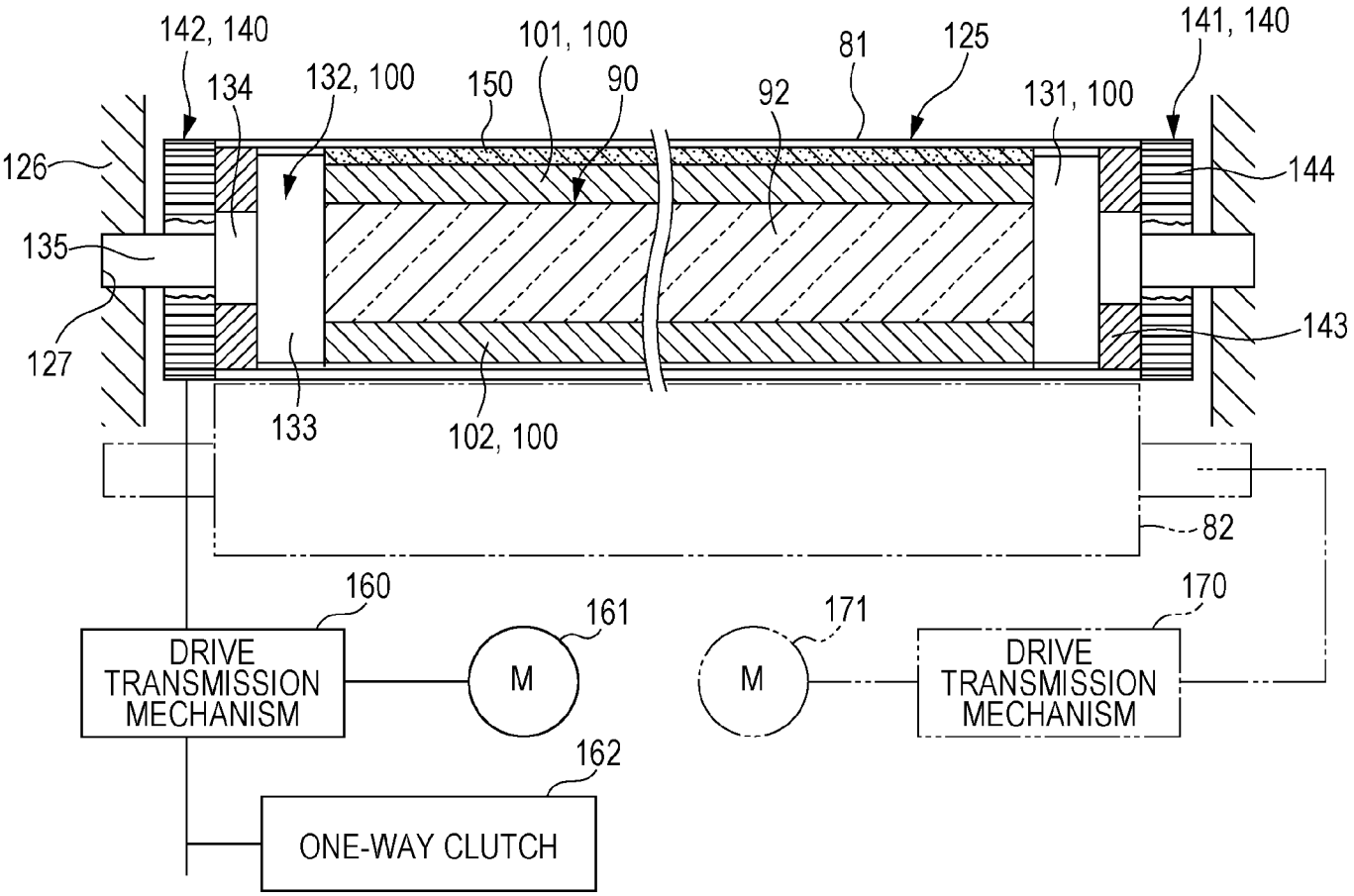
FIG. 6 is a diagram illustrating an example of a drive mechanism of the fixing device.

FIG. 6 is a diagram illustrating an example of a drive mechanism of the fixing device 80. As illustrated in FIG. 6, after the transparent-tube assembly 125 has been completed, the transparent-tube assembly 125 may be incorporated into a predetermined portion of the apparatus housing 60. In this case, the lens-pad assembly 120 of the transparent-tube assembly 125 is disposed in such a manner as to be fixed to the apparatus housing 60 by causing the support shafts 135 projecting from the ends of the lens-pad assembly 120 to be fixedly supported in support holes 127 formed in a fixing device housing 126. In a driving system of the transparent tube 81 of the transparent-tube assembly 125, for example, a drive motor 161 is connected to the ring-shaped gear 144 of one of the end caps 140 (142 in the present exemplary embodiment) via a drive transmission mechanism 160, so that a driving force applied from the drive motor 161 is transmitted to the transparent tube 81 via the one of the end caps 140 (142 in the present exemplary embodiment). Note that, in the present exemplary embodiment, the other one of the end caps 140, which is mounted on the transparent tube 81, also includes the ring-shaped gear 144, and this ring-shaped gear 144 is rotatably supported by plural support gears (not illustrated) in such a manner as to achieve a balance between loads applied to the ends of the transparent tube 81 in an axial direction of the transparent tube 81.

In addition, in the present exemplary embodiment, also the counter roller 82 includes a driving system that is different form that included in the transparent tube 81. In the driving system of the counter roller 82, a drive motor 171 is connected to the counter roller 82 via a drive transmission mechanism 170, such as a gear, a belt, or the like, and a driving force applied from the drive motor 171 is to be transmitted to the counter roller 82 via the drive transmission mechanism 170.

In the present exemplary embodiment, the different driving systems operate in the transparent tube 81 and the counter roller 82, and thus, there is a concern that a large difference in speed may occur between the transparent tube 81 and the counter roller 82 in the contact region n, in which the transparent tube 81 and the counter roller 82 are in contact with each other. Accordingly, in the present exemplary embodiment, for example, a one-way clutch 162 is disposed in a portion of the drive transmission mechanism 160 of the driving system of the transparent tube 81, and when a large difference in speed has occurred between the transparent tube 81 and the counter roller 82 in the contact region n, the one-way clutch 162 is caused to operate in such a manner as to reduce the difference in speed between the transparent tube 81 and the counter roller 82 in the contact region n. Note that, although the transparent tube 81 and the counter roller 82 include the different driving systems in the present exemplary embodiment, the present invention is not limited to this. For example, a driving system may be included in the counter roller 82, and the transparent tube 81 may be caused to move in such a manner as to follow the movement of the counter roller 82 in the contact region n, in which the transparent tube 81 and the counter roller 82 are in contact with each other.

1-3. Operation

First, in order to cause the image forming apparatus to perform an image forming process, an image-forming-mode-selection button (not illustrated) may be operated, and then a start switch (not illustrated) may be operated to be turned on. In this case, as illustrated in FIG. 1, in the image forming units 20 (20*a* to 20*d*), images formed of the toners having the different color components are formed on the corresponding photoconductors 21, and the images are sequentially transferred onto the intermediate transfer body 30 in a first transfer process. Then, when the images, which have been transferred to the intermediate transfer body 30 in the first transfer process, reach the collective transfer region (second transfer region), the images are collectively transferred onto one of the recording media S by the collective-transfer device 50, and after that, the images on the recording medium S, which have not been fixed to the recording medium S, are fixed onto the recording medium S by the fixing device 80.

As illustrated in FIG. 2 and FIG. 5, in the fixing device 80, after the laser beams Bm that are radiated from the laser array 84 of the laser-beam-radiation device 83 have been collimated by the collimator lens 86, the collimated laser beams Bm are radiated onto the light-incident position A on the transparent tube 81. The laser beams Bm, which are radiated onto the light-incident position A on the transparent tube 81, penetrate the transparent tube 81 and then penetrate the lens body 91 from the light-incident surface 92 of the lens pad 90 and penetrate the transparent tube 81 again through the light-emitting surface 93 in such a manner as to be converged on the image G formed of the toners on the recording medium S. In this state, the image G formed of the toners is fixed onto the recording medium S by the laser beams Bm.

In this fixing process, the following operations are performed in the fixing device 80 of the present exemplary embodiment.

(1) Rotational Operation of Transparent Tube 81

The transparent tube 81 receives a driving force applied from the drive motor 161 via the drive transmission mechanism 160 and one of the end caps 140 (142), rotates together with the counter roller 82, and transports one of the recording media S by nipping the recording medium S between the transparent tube 81 and the counter roller 82 in the contact region n, in which the transparent tube 81 and the counter roller 82 are in contact with each other. In this case, the transparent tube 81 moves by being guided by a circumferential portion of the lens-pad assembly 120, which has a columnar shape. More specifically, the transparent tube 81 rotates while being in contact with the light-incident surface 92 and the light-emitting surface 93 of the lens pad 90 and the guiding portions 106 of the side holding frames 101 and 102.

(2) Pressing and Converging Operations Performed by Lens Pad 90

The lens pad 90 is fixed at a predetermined position by the holding frame 100 and has the curved light-incident surface 92, which has the predetermined radius of curvature r1, and the distance L between the light-incident surface 92 and the light-emitting surface 93 is set to be a predetermined length. Thus, the laser beams Bm that are incident on the light-incident position A on the transparent tube 81 penetrate the lens pad 90, which has a predetermined focal depth, and are converged due to their predetermined property of being converged. In addition, the light-emitting surface 93 of the lens pad 90, which has been positioned at the predetermined position, presses the transparent tube 81 against the counter roller 82 with a predetermined pressing force. As a result, in the contact region n, in which the transparent tube 81 and the counter roller 82 are in contact with each other, the image G formed of the toners on the recording medium S is subjected to heat treatment by the laser beams Bm in the focal region p while being subjected to pressure treatment.

(3) Operation of Applying Transparent Liquid

In the present exemplary embodiment, the liquid applicator 150, which is impregnated with the transparent liquid such as silicone oil, is disposed in such a manner as to be in contact with the inner surface of the transparent tube 81, and thus, the transparent liquid is applied onto the inner surface of the transparent tube 81. In this case, although the transparent tube 81 and the light-incident surface 92 of the lens pad 90 are in contact with each other at the light-incident position A on the transparent tube 81, an interface air space 181 is present between the transparent tube 81 and the light-incident surface 92 due to the difference in curvature between the transparent tube 81 and the light-incident surface 92. However, in the present exemplary embodiment, the interface air space 181, which is present between the transparent tube 81 and the light-incident surface 92, is filled with the transparent liquid, and thus, the laser beams Bm that are incident on the light-incident position A on the transparent tube 81 penetrate the transparent liquid and reach the light-incident surface 92 of the lens pad 90. In the case where the interface air space 181 is not filled with the transparent liquid, part of the laser beams Bm will be reflected in the interface air space 181. However, the interface air space 181 is filled with the transparent liquid, so that this type of phenomenon in which the laser beams Bm are reflected in the interface air space 181 is prevented from occurring, and as a result, radiation loss of the laser beams Bm is reduced. In addition, since the transparent liquid is applied onto the inner surface of the transparent tube 81, even if the transparent tube 81 comes into contact with the circumferential portion of the lens-pad assembly 120, the transparent liquid functions as a lubricating material that reduces contact resistance between the transparent tube 81 and the lens-pad assembly 120.

In addition, in the present exemplary embodiment, the liquid applicator 150 is disposed in the transparent tube 81 at a position upstream of the light-incident position A and downstream of the contact region n in the direction of rotation of the transparent tube 81, and thus, the interface air space 181 that corresponds to the light-incident surface 92 of the lens pad 90 is close to a position where the transparent liquid is applied by the liquid applicator 150 and is efficiently filled with the transparent liquid. In contrast, another interface air space 181 is present in a portion that corresponds to the light-emitting surface 93 of the lens pad 90, and the other interface air space 181 is far from the position where the transparent liquid is applied by the liquid applicator 150. Thus, the other interface air space 181 is filled with an appropriate quantity of the transparent liquid, and a situation in which the laser beams Bm are unnecessarily reflected in the other interface air space 181 may be effectively avoided.

In the present exemplary embodiment, the light-emitting surface 93 of the lens pad 90 presses the transparent tube 81 against the counter roller 82, and thus, the other interface air space 181 is likely to be formed between the transparent tube 81 and the light-incident surface 93 of the lens pad 90. Therefore, the position at which the liquid applicator 150 is disposed may be set as described in the present exemplary embodiment.

(4) Selection of Focal Region of Laser Beams

Figure 7A:
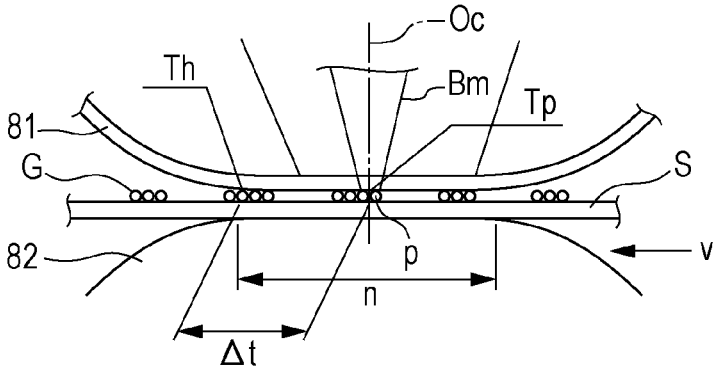
FIG. 7A is a diagram schematically illustrating a fixing process in a contact region in the fixing device.
Figure 7B:
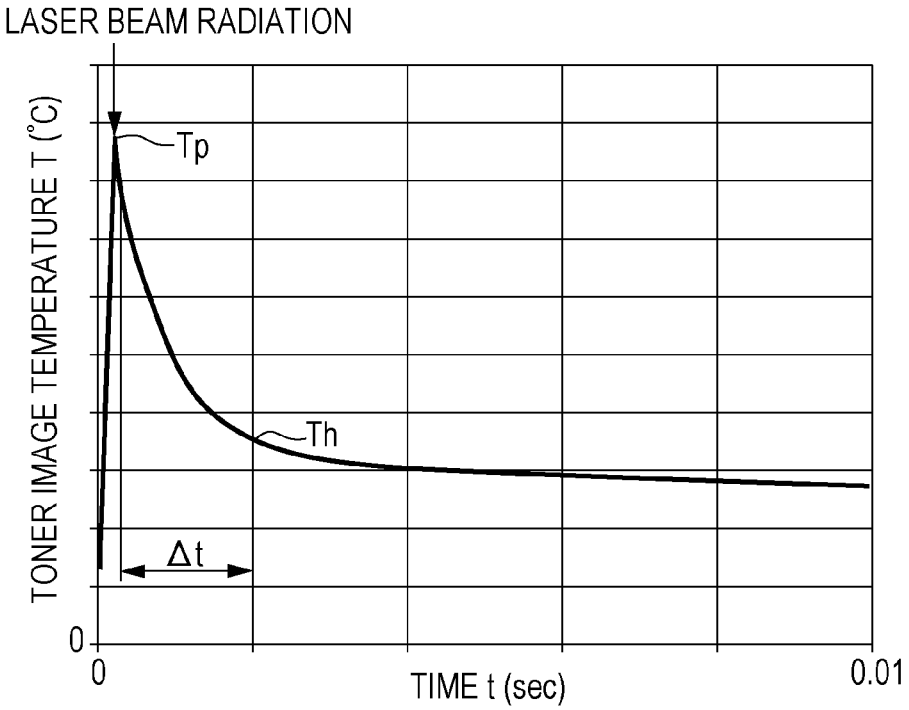
FIG. 7B is a graph showing an example of variations in temperature of a toner image when the laser beams are radiated and after the laser beams have been radiated in the fixing process performed by the fixing device.

FIG. 7A is a diagram schematically illustrating a fixing process in the contact region n in the fixing device 80, and FIG. 7B is a graph showing an example of variations in temperature of a toner image when the laser beams are radiated and after the laser beams have been radiated in the fixing process performed by the fixing device 80. In the present exemplary embodiment, as illustrated in FIG. 7A, the focal region p of the laser beams Bm is set to be in the vicinity of the substantially center Oc of the contact region n, in which the transparent tube 81 and the counter roller 82 are in contact with each other.

Variations in temperature of a toner image in the case where the toner image is not separated from the transparent tube 81 after the laser beams Bm have been radiated on the toner image are examined, and results shown in FIG. 7B are obtained. In FIG. 7B, the laser beams Bm are radiated under a radiation condition of, for example, 0.2 ms·0.81 J/cm$^2$. According to FIG. 7B, it is seen that the temperature of the toner image reaches a peak temperature Tp (e.g., 200° C.) immediately after the laser beams Bm have been radiated, a temperature of about Tp/2 (e.g., 100° C.) after 1 ms of the radiation of the laser beams Bm, and a temperature of about Tp/3 (e.g., 70° C.) after 2 ms of the radiation of the laser beams Bm. In this case, it is understood that the temperature of the toner image reaches a cooled temperature Th (e.g., 70° C. to 100° C.) at which the toner image is capable of being separated from the transparent tube 81 in the case where the toner image stays in the contact region n, in which the transparent tube 81 and the counter roller 82 are in contact with each other, for a short time, which is 1 ms to 2 ms, after the radiation of the laser beams Bm.

In the present exemplary embodiment, when the time taken for the temperature of the toner image to reach the cooled temperature Th, at which the toner image is capable of being separated from the transparent tube 81, from the peak temperature Tp after the radiation of the laser beams Bm is a time Δt as shown in FIG. 7B, a transport speed v of one of the recording media S may be set in such a manner that a time t taken for the toner image to be transported, in the contact region n in which the transparent tube 81 and the counter roller 82 are in contact with each other, from the focal region p of the laser beams Bm to a downstream end of the contact region n in the transport direction of the recording medium S is equal to or greater than the time Δt as illustrated in FIG. 7A.

In a fixing device that fixes toner onto a recording medium by radiating a laser beam onto the toner, in the case where the lens width of a lens pad is larger than a contact region in which the lens pad and a counter roller are in contact with each other, the laser beam may sometimes leak from a portion of a surface of the lens pad that is not in contact with the counter roller. There is a possibility that such a leakage of the laser beam from the lens pad may lead deformation of other components of an image forming apparatus and the like and may affect the components of the image forming apparatus, an operator who performs an operation for maintenance of the image forming apparatus, and the like. In contrast, in the present exemplary embodiment, as illustrated in FIG. 5, the lens width q of the lens pad 90 is set to be smaller than the contact region n, in which the counter roller 82 and the transparent tube 81 are in contact with each other, and an area in the contact region n excluding the lens width q is covered with the surface of the holding frame 100, which is made of a material that does not transmit the laser beams Bm. Accordingly, leakage of the laser beams Bm from the contact region n is suppressed.

In particular, in the present exemplary embodiment, portions of the surface of the holding frame 100 that are located at either side of the position (focal region p) from which the laser beams Bm are to be emitted are located in the contact region n. Accordingly, leakage of the laser beams Bm from both sides of the position from which the laser beams Bm are to be emitted is suppressed.

2. Modifications

Although the exemplary embodiment of the present invention has been described above, the present invention is not limited to the above-described exemplary embodiment, and various modifications may be made. Examples of such modifications will be described below. Note that the following modifications may be combined.

2-1. Modification 1

In the above-described exemplary embodiment, in the cross-sectional view parallel to the rotation axis of the counter roller 82, the position (focal region p) from which the laser beams Bm are to be emitted and at least a portion of the surface of the holding frame 100 may be located in the contact region n. The leakage of the laser beams Bm around the periphery of the lens pad 90 is suppressed by setting the width of the lens pad 90, through which the laser beams Bm pass, to be smaller than the contact region n in the cross-sectional view perpendicular to the rotation axis of the counter roller 82 and also in the cross-sectional view parallel to the rotation axis of the counter roller 82.

2-2. Modification 2

In the above-described exemplary embodiment, in the cross-sectional view perpendicular to the rotation axis of the counter roller 82, the contact region n includes the portions of the surface of the holding frame 100 located at either side of the position (focal region p) from which the laser beams Bm are to be emitted. The contact region n is not limited to the contact region n, which has been described above, and may include a portion of the surface of the holding frame 100 that is located at one side of the position (focal region p) from which the laser beams Bm are to be emitted. Also in this aspect, the leakage of the laser beams Bm is suppressed compared with the case where the surface of the holding frame 100 is not located in the contact region n.

2-3. Modification 3

Although, in the above-described exemplary embodiment, the lens-pad assembly 120 is formed by incorporating the lens pad 90 into the holding frame 100, which includes the side holding frames 101 and 102 and the end holding frames 131 and 132, the configuration of the lens-pad assembly 120 is not limited to this.

Figure 8A:
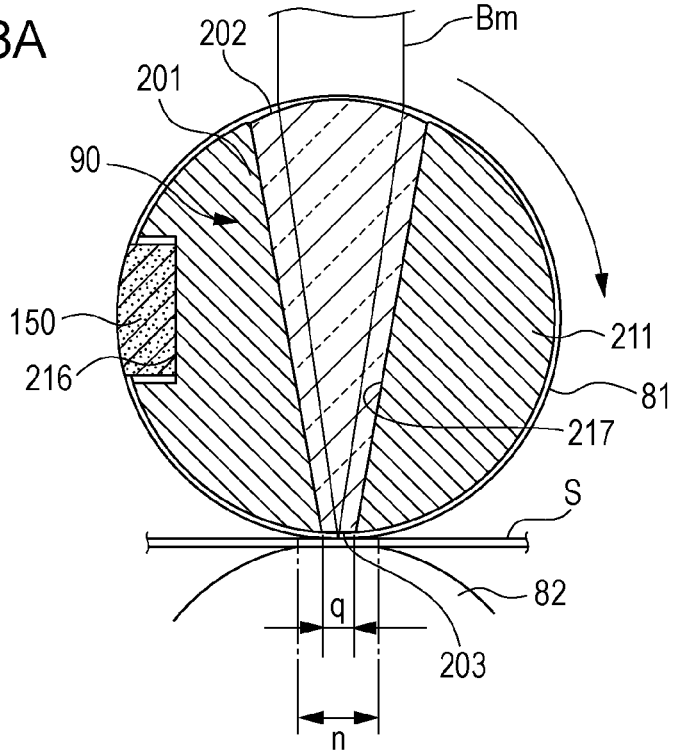
FIG. 8A is a diagram illustrating a modification of a lens-pad assembly.
Figure 8B:
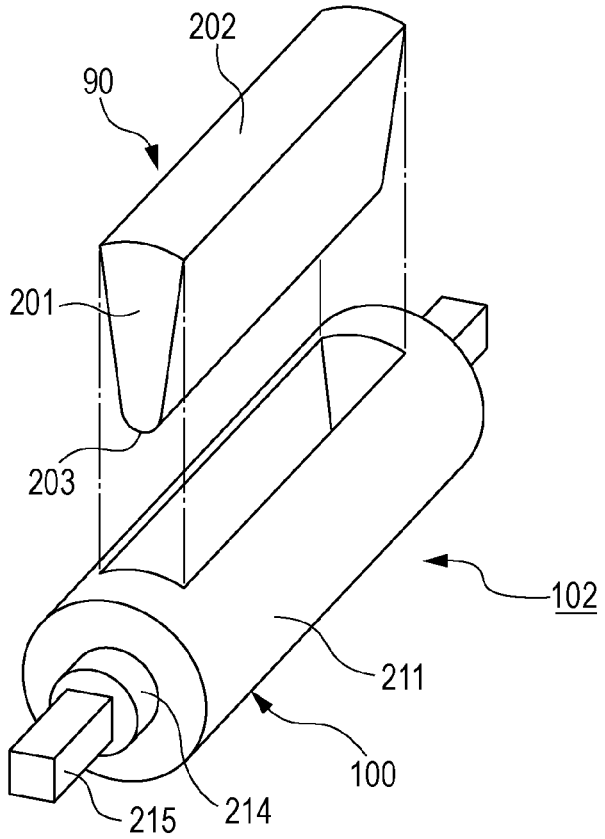
FIG. 8B is a perspective view illustrating a principal portion of the lens-pad assembly.

FIG. 8A is a diagram illustrating a modification of the lens-pad assembly 120, and FIG. 8B is a perspective view illustrating a principal portion of the lens-pad assembly 120. In the modification illustrated in FIGS. 8A and 8B, a member that includes a lens body 201, which is substantially wedge-shaped when viewed in cross section, a light-incident portion 202 formed in a portion of the lens body 201, the portion having a large width, and a light-emitting portion 203 formed another portion of the lens body 201, the other portion having a small width is prepared as the lens pad 90. In addition, a member that includes a columnar portion 211, guide-step portions 214, which are formed integrally with the columnar portion 211 at either end of the columnar portion 211, and support shafts 215, which are formed integrally with the columnar portion 211 at either end of the columnar portion 211, the columnar portion 211 having a mounting groove 216, which is used for mounting the liquid applicator 150, and a positioning hole 217, which has a shape corresponding to the shape of the lens pad 90 and which extends through the columnar portion 211, is prepared as the holding frame 100.

In Modification 3, in order to form the lens-pad assembly 120, the lens pad 90 may be inserted into the positioning hole 217 of the holding frame 100 in such a manner as to be positioned and held in a state where the light-incident portion 202 and the light-emitting portion 203 of the lens pad 90 are exposed at a peripheral surface of the holding frame 100. Note that although the member, which includes the columnar portion 211, the guide-step portions 214, and the support shafts 215 that are integrally formed with one another, has been described as the holding frame 100, for example, a holding frame body that includes the columnar portion 211 and a side holding frame that includes the guide-step portions 214 and the support shafts 215 may be provided as different members, and the holding frame body and the side holding frame may be attached and fixed to each other with an adhesive or the like when the lens-pad assembly 120 is formed.

Similarly to the above-described exemplary embodiment, in the modification illustrated in FIGS. 8A and 8B, the lens width of the lens pad 90 is set to be smaller than the contact region n, and an area in the contact region n excluding a surface that is in contact with the lens pad 90 is covered with the holding frame 100, which is made of a material that does not transmit the laser beams Bm. As a result, the leakage of the laser beams Bm from the contact region n is suppressed.

2-4. Modification 4

Although the image forming apparatus that performs image formation by employing an electrophotographic system has been described in the above-described exemplary embodiment, the image forming apparatus is not limited to that described above and may be, for example, an image forming apparatus that performs image formation by employing an electrostatic recording system using ion current flow.

2-5. Modification 5

Although the transparent tube 81 has been described as an example of a transparent cylinder member in the above-described exemplary embodiment, the transparent cylinder member is not limited to the transparent tube 81, which has been described above. The transparent cylinder member may be a rigid body or an elastic body as long as the transparent cylinder member is made of a transparent material and formed in a cylindrical shape. In addition, the transparent cylinder member may have a single-layer structure. Alternatively, the transparent cylinder member may have plural functional layers that are formed in consideration of securing the strength of the transparent cylinder member, securing a contact region in which the transparent cylinder member and a counter member are in contact with each other, a property of the transparent cylinder member that allows a toner image to separate from the transparent cylinder member, and the like.

In addition, in the above-described exemplary embodiment, the fixing device 80 may be configured not to include the transparent tube 81 (transparent cylinder member). In this case, for example, one of the recording media S may be transported by the counter roller 82 while sliding along a surface of the lens pad 90.

2-6. Modification 6

Although the counter roller 82 has been described an example of a counter member in the above-described exemplary embodiment, the counter member is not limited to the counter roller 82, which has been described above. The counter member may be any member as long as the member secures a contact region in which the member and the transparent cylinder member are in contact with each other and transports a recording medium while nipping the recording medium together with a transparent housing. From the standpoint of effectively utilizing laser beams that have passed through a recording medium, the counter member may have a reflecting surface by which the laser beams are capable of being reflected.

2-1. Modification 7

Although the laser-beam-radiation device 83 has been described as an example of a light radiation unit in the above-described exemplary embodiment, the light radiation unit is not limited to the laser-beam-radiation device 83, which has been described above. The light radiation unit may be any unit that radiates laser beams toward a predetermined light-incident position on the transparent cylinder member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a light source configured to radiate a laser beam;

a converging member configured to converge the laser beam, wherein the converging member comprises:

a lens having a first surface and a second surface, wherein the lens is configured to converge the laser beam, which has been incident on the first surface, and wherein the lens is configured to emit the laser beam from the second surface;

a holding member comprising a first material configured prevent transmission of the laser beam, wherein the holding member is configured to hold the lens; and a cylinder member comprising a second material configured to transmit the laser beam, wherein the lens and the holding member are accommodated in the cylinder member, and wherein the cylinder member is configured to rotate relative to the lens and the holding member; and a roller that is disposed at a position where the roller is in contact with the cylinder member, wherein the roller is configured to transport a recording medium, which enters between the roller and the cylinder member, and wherein in a cross-sectional view perpendicular to a rotation axis of the roller, a contact surface at which the roller and the cylinder member are in contact with each other is longer than the second surface.

2. The fixing device according to claim 1, wherein the cylinder member is configured to rotate along with rotation of the roller, and wherein the cylinder member is configured to transport the recording medium.

3. The fixing device according to claim 2, wherein in the cross-sectional view perpendicular to the rotation axis of the roller, the contact surface is opposite to surfaces of the holding member that are located at either side of the second surface.

4. The fixing device according to claim 3, wherein in a cross-sectional view parallel to the rotation axis of the roller, the contact surface overlaps with at least a surface of the holding member and the second surface.

5. An image forming apparatus comprising:

an image forming unit configured to form a toner image on a recording medium; and the fixing device according to claim 3 further configured to fix the toner image, which has been formed, onto the recording medium.

6. An image forming apparatus comprising:

an image forming unit configured to form a toner image on a recording medium; and the fixing device according to claim 4 further configured to fix the toner image, which has been formed, onto the recording medium.

7. The fixing device according to claim 2, wherein in a cross-sectional view parallel to the rotation axis of the roller, the contact surface overlaps with at least a surface of the holding member and the second surface.

8. An image forming apparatus comprising:

an image forming unit configured to form a toner image on a recording medium; and the fixing device according to claim 7 further configured to fix the toner image, which has been formed, onto the recording medium.

9. An image forming apparatus comprising:

an image forming unit configured to form a toner image on a recording medium; and the fixing device according to claim 2 further configured to fix the toner image, which has been formed, onto the recording medium.

10. The fixing device according to claim 1, wherein in the cross-sectional view perpendicular to the rotation axis of the roller, the contact surface is opposite to surfaces of the holding member that are located at either side of the second surface.

11. The fixing device according to claim 10, wherein in a cross-sectional view parallel to the rotation axis of the roller, the contact surface overlaps with at least a surface of the holding member and the second surface.

12. An image forming apparatus comprising:

an image forming unit configured to form a toner image on a recording medium; and the fixing device according to claim 11 further configured to fix the toner image, which has been formed, onto the recording medium.

13. An image forming apparatus comprising:

an image forming unit configured to form a toner image on a recording medium; and the fixing device according to claim 10 further configured to fix the toner image, which has been formed, onto the recording medium.

14. The fixing device according to claim 1, wherein in a cross-sectional view parallel to the rotation axis of the roller, the contact surface overlaps with at least a surface of the holding member and the second surface.

15. An image forming apparatus comprising:

an image forming unit configured to form a toner image on a recording medium; and the fixing device according to claim 14 further configured to fix the toner image, which has been formed, onto the recording medium.

16. An image forming apparatus comprising:

an image forming unit configured to form a toner image on a recording medium; and the fixing device according to claim 1 further configured to fix the toner image, which has been formed, onto the recording medium.

17. The fixing device according to claim 1,
wherein the contact surface is opposite to the second surface and a surface of the holding member with the cylinder member interposed therebetween.

* * * * *